US005504795A

United States Patent [19]

McGeoch

[11] Patent Number: 5,504,795

[45] Date of Patent: Apr. 2, 1996

[54] PLASMA X-RAY SOURCE

[75] Inventor: Malcolm W. McGeoch, Brookline, Mass.

[73] Assignee: Plex Corporation, Brookline, Mass.

[21] Appl. No.: 383,889

[22] Filed: Feb. 6, 1995

[51] Int. Cl.[6] ..... H01J 35/00

[52] U.S. Cl. ..... 378/119; 378/122

[58] Field of Search ..... 378/119, 122

[56] References Cited

U.S. PATENT DOCUMENTS

| | | | |
|---|---|---|---|
| 4,635,282 | 1/1987 | Okada et al. | 378/119 |
| 4,752,946 | 6/1988 | Gupta et al. | 378/119 |
| 4,837,794 | 6/1989 | Riordan et al. | 378/119 |

*Primary Examiner*—Craig E. Church
*Attorney, Agent, or Firm*—Wolf, Greenfield & Sacks

[57] ABSTRACT

A plasma x-ray source includes a chamber containing a gas at a prescribed pressure, the chamber defining a pinch region having a central axis, an RF electrode disposed around the pinch region for preionizing the gas in the pinch region to form a plasma shell that is symmetrical around the central axis, and a pinch anode and a pinch cathode disposed at opposite ends of the pinch region. The pinch anode and the pinch cathode produce a current through the plasma shell in an axial direction and produce an azimuthal magnetic field in the pinch region in response to a high energy electrical pulse. The azimuthal magnetic field causes the plasma shell to collapse to the central axis and to generate x-rays. Prior to collapse, the plasma shell may have a cylindrical shape or a spherical shape.

21 Claims, 3 Drawing Sheets

PLASMA X-RAY SOURCE

FIELD OF THE INVENTION

This invention relates to a plasma x-ray source of the Z-pinch type and, more particularly, to an x-ray source that utilizes the collapse of a precisely controlled, low-density plasma shell to produce intense pulses of soft x-rays.

BACKGROUND OF THE INVENTION

A number of experimental studies have been performed on an x-ray source called the "gas puff Z-pinch" source. This device was first discussed by J. Shiloh et al. in *Physical Review Letters,* Vol. 40, No. 8, pp. 515–518 (1978). Subsequent versions have been described by C. Stallings et al. in *Applied Physics Letters,* Vol. 35, No. 7, pp. 524–526 (1979) and by J. S. Pearlman et al. in *Journal of Vacuum Science and Technology,* Vol. 19, No. 4, pp. 1190–1193 (1981). One form of this device is disclosed in U.S. Pat. No. 4,635,282 issued Jan. 6, 1987 to Okada et al.

The gas puff Z-pinch source involves the introduction of a "gas puff" into a vacuum chamber through an annular orifice. The annular orifice causes the gas puff to form a roughly cylindrical shell within the vacuum chamber. A high current pulse ionizes the gas and produces a plasma shell. The magnetic field associated with the high current causes the plasma shell to collapse toward the axis of the device. The collapsed plasma shell generates x-rays along the device axis. This device has a number of problems and disadvantages which render it impractical for commercial application.

In prior art systems, the driving current pulse has been of much longer duration than the time taken for movement of the plasma shell to the axis of the device. This has meant that the current continued to flow through the plasma in an axial direction, delivering a concentrated flux of ions and electrons onto the nearby part of the electrode structure and causing rapid electrode erosion at this location. The erosion involves the evaporation of metal, which can be deposited on the x-ray output window and decrease its transmission. Also, the erosion can form a particle beam in the direction of the x-ray exit, necessitating elaborate particle removal mechanisms as described, for example, in U.S. Pat. No. 4,837,794 issued Jun. 6, 1989 to Riordan et al.

The passage of current through an axial plasma, while heating the plasma as desired for x-ray production, also causes plasma instabilities to develop, with the result that x-rays are produced from a rapidly moving sequence of hot spots rather than from a single location, as discussed by P. Choi et al. in *Review of Scientific Instruments,* Vol. 57, p. 2162 (1986). This lowers the usefulness of the source for purposes such as microscopy and lithography, for which stable source position is required.

A further disadvantage of the gas puff Z-pinch source is its requirement for a gas release mechanism, which has been mechanical in all known prior art implementations, and carries with it the failure modes associated with the wear and fatigue of moving mechanisms. The gas is injected into the device principally in order to provide an approximately cylindrical starting shell of gas for the magnetic acceleration process. The device conducts current preferentially through the gas shell when a voltage is applied between its electrodes and, hence, a cylindrical plasma shell is formed. In these devices, the plasma shell may be non-uniform and asymmetrical about the axis.

In all known prior art Z-pinch plasma systems, the high current which drives the plasma acceleration has been switched using high pressure spark gaps. This type of switch has very limited life expectancy ($10^5$ pulses) because of electrode pitting and metal evaporation which coats the switch insulator. For the application of x-rays to semiconductor lithography, up to $10^6$ x-ray pulses per day must be generated without frequent servicing of the switches.

The gas puff creates a density gradient in the direction away from the pinch electrode at which the gas is released. When current is passed through this gas cloud in an axial direction, the heavier parts of it are accelerated more slowly, with the result that they reach the axis later than the lighter parts. This creates a moving x-ray source spread out in time over several tens of nanoseconds. The source peak intensity is therefore degraded.

The advantages of preionization using an electron beam in a small scale Z-pinch x-ray source are described by I. Weinberg et al. in *Nuclear Instruments and Methods in Physics Research,* Vol. A242, pp. 535–538 (1986). A method for preionizing a static gas cylinder is described by W. Hartmann et al. in *Applied Physics Letters,* Vol. 58, No. 23, Jun. 10, 1991, pp. 2619–2621. The disclosed method involves a conical discharge at one end of the cylinder and does not produce uniform preionization.

SUMMARY OF THE INVENTION

According to the present invention, a plasma x-ray source comprises a chamber containing a gas at a prescribed pressure, the chamber defining a pinch region having a central axis, an RF electrode disposed around the pinch region for preionizing the gas in the pinch region to form a plasma shell that is symmetrical around the central axis in response to application of RF energy to the RF electrode, and a pinch anode and a pinch cathode disposed at opposite ends of the pinch region. The pinch anode and the pinch cathode produce a current through the plasma shell in an axial direction and produce an azimuthal magnetic field in the pinch region in response to application of a high energy electrical pulse to the pinch anode and the pinch cathode. The azimuthal magnetic field causes the plasma shell to collapse to the central axis and to generate x-rays.

Prior to collapse, the plasma shell preferably has a cylindrical shape or a shape defined by an arc that is rotated about the central axis. The RF electrode preferably has a spiral configuration around the central axis. The pinch cathode may have an annular groove for attachment of the plasma shell. In a preferred embodiment, the pinch cathode and the pinch anode each includes an axial opening to limit the vaporization of the electrodes by the plasma.

The high energy electrical pulse preferably has pulse width that is approximately equal to the time required for the plasma shell to collapse to the central axis. The pulse width is preferably about 200 to 250 nanoseconds.

The x-ray source preferably includes means for causing the gas to flow through the pinch region in an axial direction opposite to the direction in which x-rays are extracted.

The electrical drive circuit for the x-ray source preferably comprises an electrical energy source and a multiple channel pseudospark switch responsive to the electrical energy source for generating the high energy electrical pulse.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
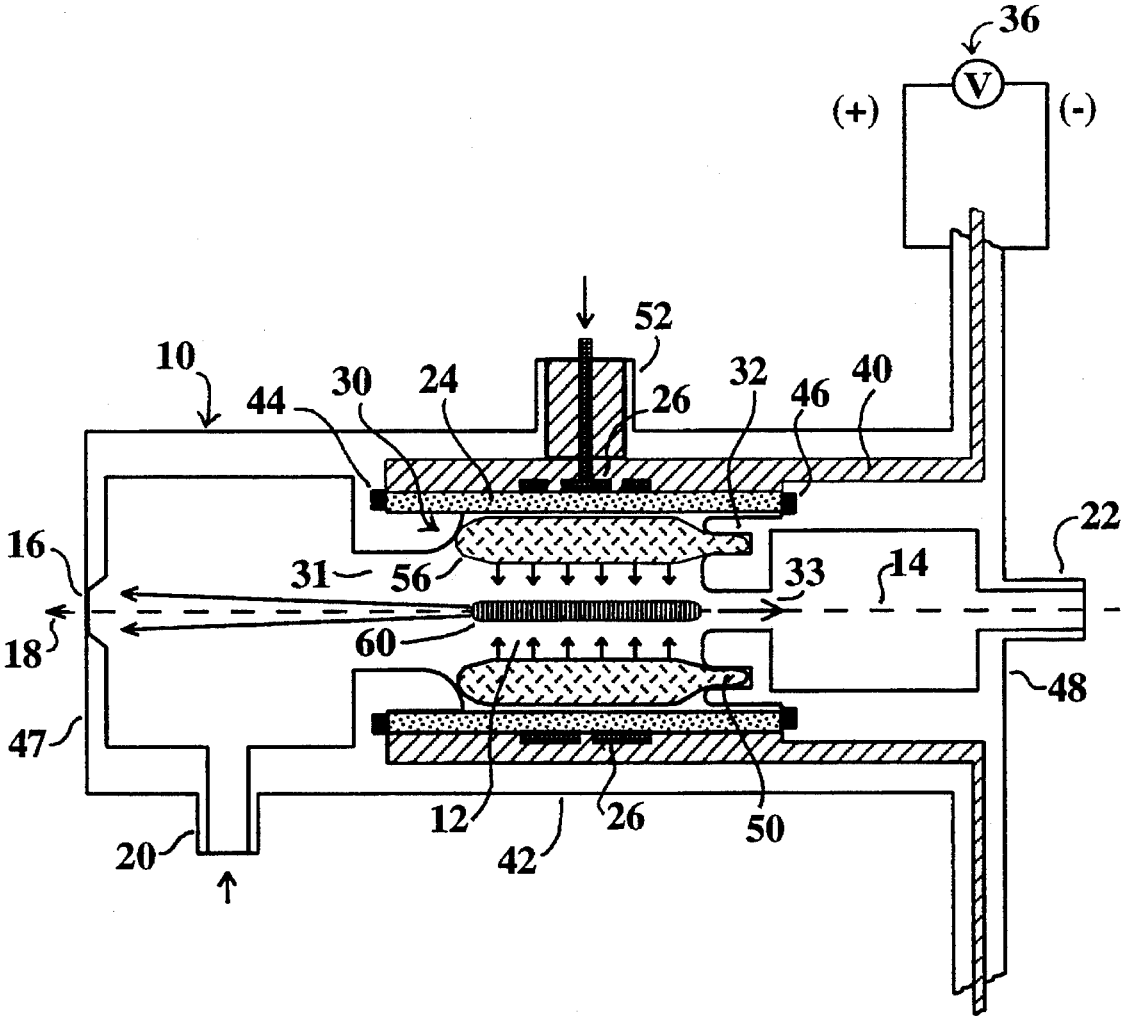
FIG. 1 is a cross-sectional view of a plasma x-ray source in accordance with the invention, wherein the pinch region has a cylindrical shape.

A first embodiment of a plasma x-ray source in accordance with the present invention is shown in FIG. 10. An enclosed chamber 10 defines a pinch region 12 having a central axis 14. The chamber 10 includes an x-ray transmitting window 16 located on axis 14. A gas inlet 20 and a gas outlet 22 permit a gas at a prescribed pressure to flow through the pinch region 12. The embodiment of FIG. 1 has a generally cylindrical pinch region 12.

A cylindrical dielectric liner 24, which can be a ceramic material, surrounds pinch region 12. An RF electrode 26 is disposed on the outside surface of dielectric liner 24. A pinch anode 30 is disposed at one end of the pinch region 12, and a pinch cathode 32 is disposed at the opposite end of pinch region 12. The portion of pinch anode 30 adjacent to pinch region 12 has an annular configuration disposed on the inside surface of the dielectric liner 24. Similarly, the portion of cathode 32 adjacent to pinch region 12 has an annular configuration inside dielectric liner 24 and spaced from dielectric liner 24. In a preferred embodiment, the pinch cathode 32 includes an annular groove 50 which controls the location at which the plasma shell attaches to cathode 32. Preferably, the anode 30 has an axial hole 31, and the cathode 32 has an axial hole 33 to prevent vaporization by the collapsed plasma, as described below. The anode 30 and the cathode 32 are connected to an electrical drive circuit 36 and are separated by an insulator 40. The anode 30 is connected through a cylindrical conductor 42 to the drive circuit 36. The cylindrical conductor 42 surrounds pinch region 12. As described below, a high current pulse through cylindrical conductor 42 contributes to an azimuthal magnetic field in pinch region 12. An elastomer ring 44 is positioned between anode 30 and one end of dielectric liner 24, and an elastomer ring 46 is positioned between cathode 32 and the other end of dielectric liner 24 to ensure that the chamber 10 is sealed vacuum tight.

In the embodiment of FIG. 1, the chamber 10 is defined by cylindrical conductor 42, an end wall 47 and an end wall 48. The cylindrical conductor 42 and end wall 47 are electrically connected to anode 30, and end wall 48 is electrically connected to cathode 32. It will be understood that different chamber configurations can be used within the scope of the invention.

The RF electrode 26 is connected through an RF power feed 52 to an RF generator 200 (FIG. 3) which supplies RF power for preionizing the gas in a cylindrical shell of pinch region 12. The RF power preferably has a power level greater than one kilowatt. In a preferred embodiment, the RF power is 5 kilowatts at 1 GHz. It will be understood that different RF frequencies and power levels can be used within the scope of the present invention. In a preferred embodiment, the RF electrode 26 comprises a center-fed spiral antenna wrapped around the dielectric liner 24, with a total angular span of +/−200°. It will be understood that different spiral configurations and different RF electrode configurations can be utilized for preionizing the gas in the pinch region 12. The spiral configuration described above has been found to provide satisfactory results.

The drive circuit 36 supplies a high energy, short duration of electrical pulse to anode 30 and cathode 32. In a preferred embodiment, the pulse is 25 kilovolts at a current of 300 kiloamps and a duration of 200–250 nanoseconds.

The gas contained within the chamber 12 can be any gas having suitable transitions for x-ray generation. The gas pressure is selected to give a high enough gas density to ensure a high collision rate as the gas stagnates on axis but not so high a density that the motion is slow and the incoming kinetic energy is too low to create the high temperature needed for x-ray emission. Typically the pressure level is between 0.1 and 10 tort. In one example, neon gas at a pressure of 1 torr was utilized. Gas is caused to flow through the pinch region 12 at a rate on the order of 1 S.C.C.M. At this flow rate, the gas is essentially static with respect to the time scale of x-ray generation as described below.

The inside wall of dielectric liner 24, the anode 30 and the cathode 32 define a cylinder of low density gas. RF power is applied to the RF electrode 26 to cause ionization within the gas cylinder. It is a property of the application of intense RF power to a gas surface that the ionization is concentrated in a surface layer. This is exactly what is needed to create a precise cylindrical plasma shell 56 for the subsequent passage of current. Once the gas has been preionized by RF energy, the drive circuit 36 is activated to apply a high energy electrical pulse between anode 30 and cathode 32. Typically, the RF power is applied 1–100 microseconds before the drive circuit 36 is activated. The high energy pulse causes electrons to flow from the pinch cathode 32 to the pinch anode 30. Initially, the current flows in the preionized outer layer of the gas cylinder and forms plasma shell 56. The return current flows back to the drive circuit 36 through the outer cylindrical conductor 42. An intense azimuthal magnetic field is generated between the outer current sheet through cylindrical conductor 42 and the current sheet in the plasma shell 56. The magnetic field applies a pressure which pushes the plasma shell 56 inward toward the axis 14. After approximately 200–250 nanoseconds, the drive circuit 36 is discharged and the current drops to a lower value. At approximately the same time, the plasma shell reaches the axis 14 with high velocity, where its motion is arrested by collisions with the incoming plasma shell from the opposite radial direction. The result of this stagnation process is the conversion of kinetic energy into heat, which further ionizes the gas into high ionization states that radiate x-rays strongly in all directions. In the case of population inversion on an x-ray transition, the radiation is concentrated in the two axial directions via amplified spontaneous emission. Thus with reference to FIG. 1, the plasma shell 56 collapses to form a collapsed plasma 60 on axis 14 in approximately 200–250 nanoseconds.

Figure 2:
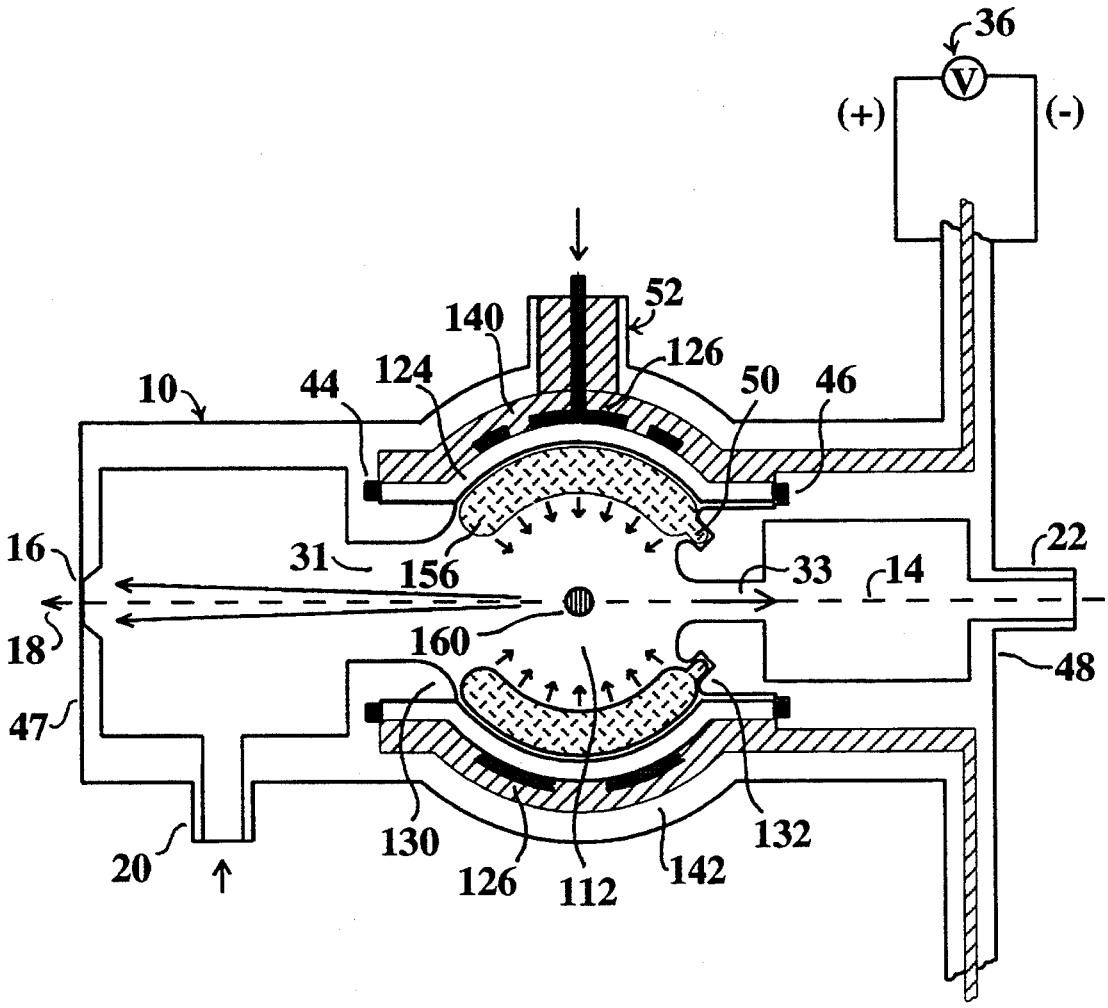
FIG. 2 is a cross-sectional view of a plasma x-ray source in accordance with the invention, wherein the pinch region has a generally spherical shape.

A second embodiment of a plasma x-ray source in accordance with the invention is shown in FIG. 2. Corresponding elements in FIGS. 1 and 2 have the same reference numerals. In the embodiment of FIG. 2, an approximately spherical pinch region 112 is defined between a dielectric liner 124 having an arc-shaped portion, a pinch anode 130 and a pinch cathode 132. Because of the spherical shape of pinch region 112, an RF electrode 126, an insulator 140 and a conductor 142 connected to anode 130 all have spherical shapes. It will be understood that the pinch region 112 is not a complete sphere, but is defined by rotation of the arc-shaped portion of dielectric liner 124 about axis 14. As a result, plasma shell 156 has a spherical configuration and collapses toward a point 160 on axis 14. The operation of the plasma x-ray source shown in FIG. 2 is generally the same as the operation of the source shown in FIG. 1 and described above, except that the plasma shell 156 collapses toward point 160 rather than a line.

The plasma x-ray source of the present invention overcomes the disadvantages of the gas puff Z-pinch sources described above. In the present invention, a low inductance circuit keeps the high current pulse shorter than or equal to the time for axial convergence of the plasma shell, so that very little current flows through the collapsed plasma on axis 14 and the electrodes do not reach the temperature required for rapid evaporation. In addition, each electrode has an axial hole which ensures that the current flowing through the collapsed plasma can never concentrate on a small electrode area but is spread around the periphery of the electrode hole.

Plasma heating to the temperature required for x-ray emission takes place as a result of stagnation of the collapsed plasma shell on the axis 14 of the x-ray source. The driving current is shut off at or before the moment of stagnation. It is not necessary to pass an axial current through the collapsed plasma to achieve heating, and therefore the instabilities associated with this heating method are avoided.

Preionization and shaped electrodes are provided to cause the initiation of a uniform cylindrical or spherical plasma shell within a static gas volume, without requiring an injection of gas. The present invention uses applied RF power to ionize only the surface of a static gas volume and does not use a gas puff. Another advantageous feature of the present invention is to provide the annular groove in the cathode in order to locate the cathode plasma precisely. This gives an exact geometric definition to the inner surface of the plasma shell, which is essential for accurate convergence on the axis of the source. In the present invention, the unionized gas on the inside of the initial plasma shell is ionized by the inward passage of the plasma shell and joins the gas already in motion, with the result that all the ionized gas is projected toward the axis where its energy is deposited in a hot and dense plasma.

The high current pulse is preferably switched from an energy storage capacitor into the source using a switch known as a multiple channel pseudospark switch. This switch type has long life (greater than $10^7$ pulses), can carry very high currents, and is able to survive heavy current reversals such as are common in the operation of plasma pinch loads.

The use of a static gas volume with uniform preionization ensures that the plasma shell retains its shape during acceleration, and all parts of it reach the axis simultaneously. Apart from giving the highest peak x-ray intensity, this has the additional merit of providing a long path for x-ray amplification by stimulated emission.

A block diagram of a plasma x-ray system incorporating the plasma x-ray source described above is shown in FIG. 3. RF generator 200 supplies RF energy to RF electrode 26 through RF power feed 52. The RF generator 200 may be any suitable source of the required frequency and power level. A regulated gas supply 202 is connected to gas inlet 20, and a vacuum pump 204 is connected to gas outlet 22. The gas supply 202 and the vacuum pump 204 produce a gas flow through pinch region 12 in a direction opposite the x-ray beam 18 and control the pressure at the desired pressure level.

Figure 3:
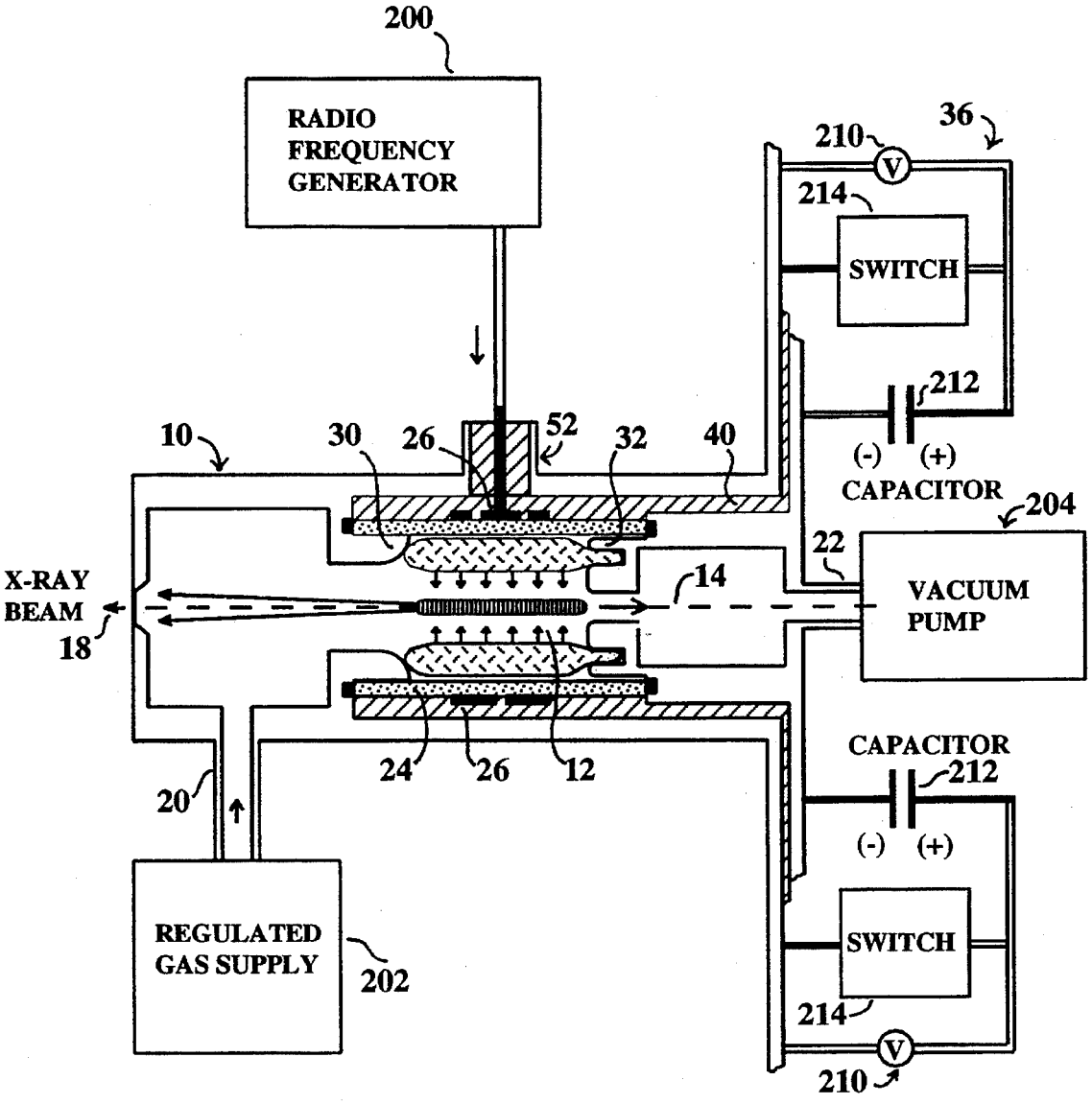
FIG. 3 is a block diagram of a plasma x-ray system in accordance with the invention.

The drive circuit 36 is shown in more detail in FIG. 3. Preferably, multiple circuits are connected in parallel to the pinch anode 30 and the pinch cathode 32 to achieve the required current level. A preferred embodiment utilizes eight drive circuits connected in parallel, each generating about 40 kiloamps. As shown in FIG. 3. each drive circuit includes a voltage source 210 connected to an energy storage capacitor 212. A switch 214 is connected in parallel with storage capacitor 212. The switch 214 preferably comprises a multiple channel pseudospark switch as described in copending application Ser. No. 08/237,010 filed May 2, 1994, which is hereby incorporated by reference. The switches 214 in the parallel circuits are closed simultaneously to generate a high energy pulse for application to the anode 30 and cathode 32.

A plasma x-ray source that has been realized in accordance with the present invention has the following parameters. The cylindrical gas volume had a diameter of 2.5 cm and a length of 1.7 cm. It was filled with neon at a pressure of 0.5 to 1.0 tort and preionized with 4 kilowatts of RF power at 1 GHz. The drive circuit stored 500 joules at a voltage of 25 kilowatts. After a preionization RF pulse of duration 10 microseconds, the energy in the drive circuit was switched into the pinch plasma via the parallel operation of eight multichannel pseudospark switches, generating a current of 300 kiloamps. The plasma collapsed to a diameter of less than 0.1 cm and radiated >2 joules of x-rays in the 10–15 angstrom spectral region. The device operated repetitively at 2 pulses per second, accumulating $>10^5$ pulses.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A plasma x-ray source comprising:

a chamber containing a gas at a prescribed pressure, said chamber defining a pinch region having a central axis;

an RF electrode disposed around said pinch region for preionizing the gas in said pinch region to form a plasma shell that is symmetrical around said central axis in response to application of RF energy to said RF electrode; and a pinch anode and a pinch cathode disposed at opposite ends of said pinch region for producing a current through said plasma shell in an axial direction and for producing an azimuthal magnetic field in said pinch region in response to application of a high energy electrical pulse to said pinch anode and said pinch cathode, whereby said azimuthal magnetic field causes said plasma shell to collapse to said central axis and to generate x-rays.

2. A plasma x-ray source as defined in claim 1 wherein, prior to collapse, said plasma shell has a cylindrical shape.

3. A plasma x-ray source as defined in claim 1 wherein, prior to collapse, said plasma shell has a shape defined by an arc that is rotated about said central axis.

4. A plasma x-ray source as defined in claim 1 wherein, prior to collapse, said plasma shell has a substantially constant diameter along said central axis.

5. A plasma x-ray source as defined in claim 1 wherein, prior to collapse, said plasma shell has a relatively large diameter in a central portion of said pinch region and a relatively small diameter near the ends of said pinch region.

6. A plasma x-ray source as defined in claim 1 wherein said RF electrode has a spiral configuration around said central axis.

7. A plasma x-ray source as defined in claim 1 wherein said pinch cathode has an annular groove for attachment of said plasma shell.

8. A plasma x-ray source as defined in claim 1 wherein said pinch cathode and said pinch anode each includes an axial opening.

9. A plasma x-ray source as defined in claim 1 wherein said chamber includes a dielectric liner surrounding said pinch region.

10. A plasma x-ray source as defined in claim 9 wherein RF electrode is disposed on an outer surface of said dielectric liner.

11. A plasma x-ray source as defined in claim 1 wherein said high energy electrical pulse has a pulse width that is approximately equal to a time required for said plasma shell to collapse to said central axis.

12. A plasma x-ray source as defined in claim 1 further including means for causing said gas to flow through said pinch region.

13. A plasma x-ray source as defined in claim 1 further including means for causing said gas to flow through said pinch region in an axial direction opposite to the direction in which x-rays are extracted.

14. A plasma x-ray system comprising:

a chamber containing a gas at a prescribed pressure, said chamber defining a pinch region having a central axis;

an RF electrode disposed around said pinch region for preionizing the gas in said pinch region to form a plasma shell that is symmetrical around said central axis in response to application of RF energy to said RF electrode;

a pinch anode and a pinch cathode disposed at opposite ends of said pinch region for producing a current through said plasma shell in an axial direction and for producing an azimuthal magnetic field in said pinch region in response to application of a high energy electrical pulse to said pinch anode and said pinch cathode;

an RF source connected to said RF electrode for supplying RF energy thereto;

an electrical drive circuit connected to said pinch anode and said pinch cathode for supplying said high energy electrical pulse thereto; and means for causing said gas to flow through said pinch region, 15. A plasma x-ray system as defined in claim 14 wherein said drive circuit comprises an electrical energy source and a multiple channel pseudospark switch responsive to said electrical energy source for generating said high energy electrical pulse.

16. A plasma x-ray system as defined in claim 15 wherein high energy electrical pulse generated by said multiple channel pseudospark switch has a pulse width that is approximately equal to a time required for said plasma shell to collapse to said central axis.

17. A plasma x-ray system as defined in claim 14 wherein said RF electrode has a spiral configuration around said central axis.

18. A plasma x-ray system as defined in claim 14 wherein said pinch cathode has an annular groove for attachment of said plasma shell.

19. A plasma x-ray system as defined in claim 14 wherein said pinch cathode and said pinch anode each includes an axial opening.

20. A plasma x-ray system as defined in claim 14 wherein, prior to collapse, said plasma shell has a substantially constant diameter along said central axis.

21. A plasma x-ray system as defined in claim 14 wherein, prior to collapse, said plasma shell has a relatively large diameter in a central portion of said pinch region and a relatively small diameter near the ends of said pinch region.

* * * * *